United States Patent [19]

Erwin et al.

[11] 4,025,738

[45] May 24, 1977

[54] REVERSIBLE SNAP-ACTION SWITCH WITH CAM OPERATOR AND LOST MOTION STRUCTURE

[75] Inventors: Carl Lloyd Erwin, Anaheim; Michael John Howett, Fountain Valley; Howard Hideo Nojiri, Riverside, all of Calif.

[73] Assignee: Bourns, Inc., Riverside, Calif.

[22] Filed: Mar. 1, 1976

[21] Appl. No.: 662,649

[52] U.S. Cl. ..... 200/6 B; 200/6 BB; 200/67 E; 200/153 V; 200/153 LB; 200/238; 200/284

[51] Int. Cl.[2] ..... H01H 21/38; H01H 3/48

[58] Field of Search ..... 200/6 R, 6 B, 6 BA, 200/6 BC, 6 C, 17 R, 18, 67 F, 153 V, 153 LB, 155 R, 245–247, 284, 291, 307, 336, 67 E, 237–239

[56] References Cited

UNITED STATES PATENTS

| | | | |
|---|---|---|---|
| 3,162,731 | 12/1964 | Braunagel | 200/11 A |
| 3,283,596 | 11/1966 | Rueser | 74/54 |
| 3,407,278 | 10/1968 | Stoi | 200/153 V |
| 3,467,800 | 9/1969 | Barr | 200/153 |
| 3,519,777 | 7/1970 | Kaiser | 200/153 V X |
| 3,627,937 | 12/1971 | Swanke et al. | 200/153 V X |

*Primary Examiner*—James R. Scott
*Attorney, Agent, or Firm*—Paul H. Ware; William G. Becker

[57] ABSTRACT

A reversible snap-action switch including a drive member and a switch-actuating driven member connected by a lost motion coupling. The relative position between the drive and driven members is shifted by substantially the lost motion distance as the drive member moves the driven member through a switching zone and then reverses its direction to return to its original position. In each direction of movement a bidirectional accelerating means imparts a snap-action motion to the drive member. This motion is coordinated with the position of the driven member so that switching occurs during the snap-action motion in each direction of movement, thereby inhibiting any hesitation in making or breaking the switch contacts. The invention also includes a cement-free mounting for the switch contacts.

28 Claims, 8 Drawing Figures

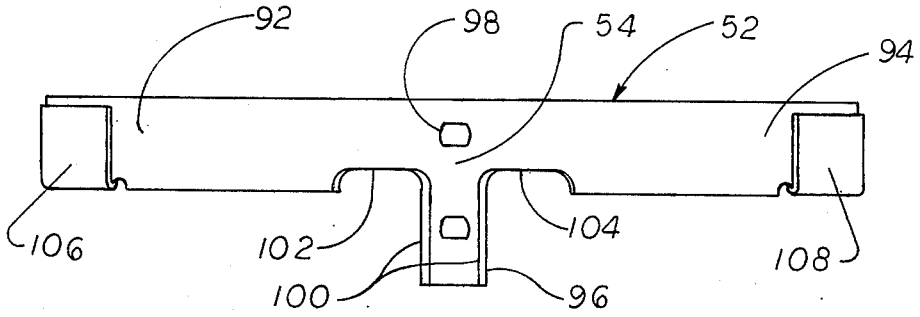
Fig 4
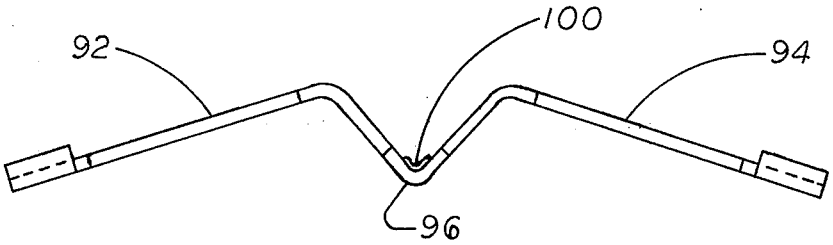
Fig 5
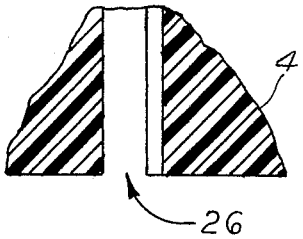
Fig 6
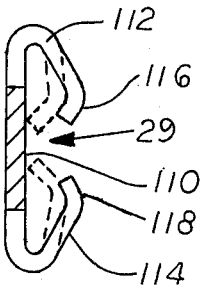

REVERSIBLE SNAP-ACTION SWITCH WITH CAM OPERATOR AND LOST MOTION STRUCTURE

BACKGROUND OF THE INVENTION

This invention relates to switches, and more particularly to reversible snap-action electrical switches.

In the electrical switch art, and particularly for relatively small, manually-operated switches, actuation solely by movement of the operator's hand can pose a number of problems. Moving the switch contacts at the same speed as the operator's hand can cause arcing between the contacts which could be avoided by a more rapid movement. In addition, the operator may move the switch control in a hesitating, unsteady manner, thereby producing additional arcing that could be avoided by a more positive motion.

Various snap-action switch designs have been employed in the past to produce a faster switching action and thereby minimize the above problems. In one approach separate actuating and switching members are connected by a lost motion coupling; the actuating member is manually advanced while the switching member is held in place until a point is reached at which it is released and snaps forward at an accelerated rate to produce a rapid switching.

The configuration of some of these switches is such that a snap-action motion occurs only when the switch contacts are moved from a first to a second state, and not when they are moved in the reverse direction back to the first state. In others, the switching member is successively snapped along a series of fixed positions, dwelling at each position until dislodged by a camming action from the actuating member.

While many of the above mechanisms do perform their intended function satisfactorily, there is still a need for a bidirectional snap-action switch which requires only a single dwelling location for the drive member. For example, the drive member may be interconnected with potentiometer units. In this case a snap-action motion may be desirable only at the beginning or end of the potentiometer resistance track.

SUMMARY OF THE INVENTION

The principal object of this invention is the provision of a novel and improved switch having a bidirectional snap-action mechanism to facilitate rapid contact movement from a first to a second switching state and back to the first state when a control member is moved away from and then returned to an initial position.

Another object is the provision of such a switch with a positive drive mechanism to ensure steady switching.

A further object is the provision of such a switch in which multiple dwelling positions for the switching mechanism are unnecessary.

Another object is the provision of an improved, cement-free conact mounting for use with the switch.

An additional object is the provision of a novel and improved reversible snap-action swtich having a relatively simple and low cost contruction.

In the accomplishment of these and other objects, a reversible snap-action switch is disclosed which comprises a switch means, an operating drive member, a driven member adapted to actuate the switch means, a bidirectional lost motion coupling connecting the drive and driven members, and means for accelerating the drive member in a bidirectional snap-action motion when the driven member is within a predetermined switching zone. The drive member is adapted to drive the driven member through the switching zone from either direction, the relative position of the drive and driven members being shifted by substantially the lost motion distance from the beginning of a drive movement in one direction to the beginning of a drive movement in the opposite direction. Switching in each direction accordingly occurs during the snap-action motion.

In a preferred embodiment the drive and driven members are generally cylindrical and mutually concentric, the lost motion coupling permitting a limited amount of relative rotation between the two. The accelerating mechanism consists of a caret-shaped protuberance on the drive member which cooperates with a detent spring held by the switch housing. The spring, which has a structure designed to strengthen and distribute stress away from the detent, flexes and rides up one ramp of the protuberance as the drive member is rotatingly advanced. Upon passing the protuberance apex, the spring accelerates the drive member by riding down the opposite ramp and releasing spring tension. In this manner a snap-action motion is imparted to the drive member and transmitted thereby to the driven member. Upon reversing the drive member's direction of rotation the switch is snapped back to its original state as the spring rides up and down the ramps in the reverse sequence. The lost motion distance is such that switching occurs during the snap-action motion in both directions. The lost motion coupling consists of a boss projecting from one of the drive and driven members into a recess in the other member, the size of the boss in the direction of rotation being less than that of the recess by substantially the lost motion distance.

In the above embodiment a strip of flexible, resilient, conductive material is mounted to the switch housing so as to bias a contact at the inner end of the strip against a switch-actuating cam surface on the driven member. The strip is mounted with one end extending out of the housing by a cement-free structure comprising a base on the strip, a pair of cantilever spring arms extending toward the axis of the strip from opposite sides of the base, and stiffly flexible members projecting from each spring arm back toward the base. The base and one of the spring arms serve to guide insertion of the mounting structure into a slot in the housing until the respective projecting member bottoms against the base, thereby substantially increasing the resistance to additional flexing of the spring arm. Further insertion serves to lock the strip in place and isolate mechanical movements at one end of the strip from the other end.

A modified embodiment employs a lost motion coupling comprising a plurality of webs joining the drive and driven members. Each of the webs is greater in length than the radial distance between the two members, enabling a limited amount of relative rotation between them.

DESCRIPTION OF THE DRAWINGS

Further advantages and features of the invention will be apparent to those skilled in the art from the ensuring detailed description thereof, taken together with the accompanying drawings, in which:

FIGS. 4 and 5 are respectively top and frontal elevation views of a detent spring employed in the snap-action mechanism;

FIG. 6 is a sectional view of structure for mounting a flexible contact in the switch housing;

DETAILED DESCRIPTION

Figure 1:
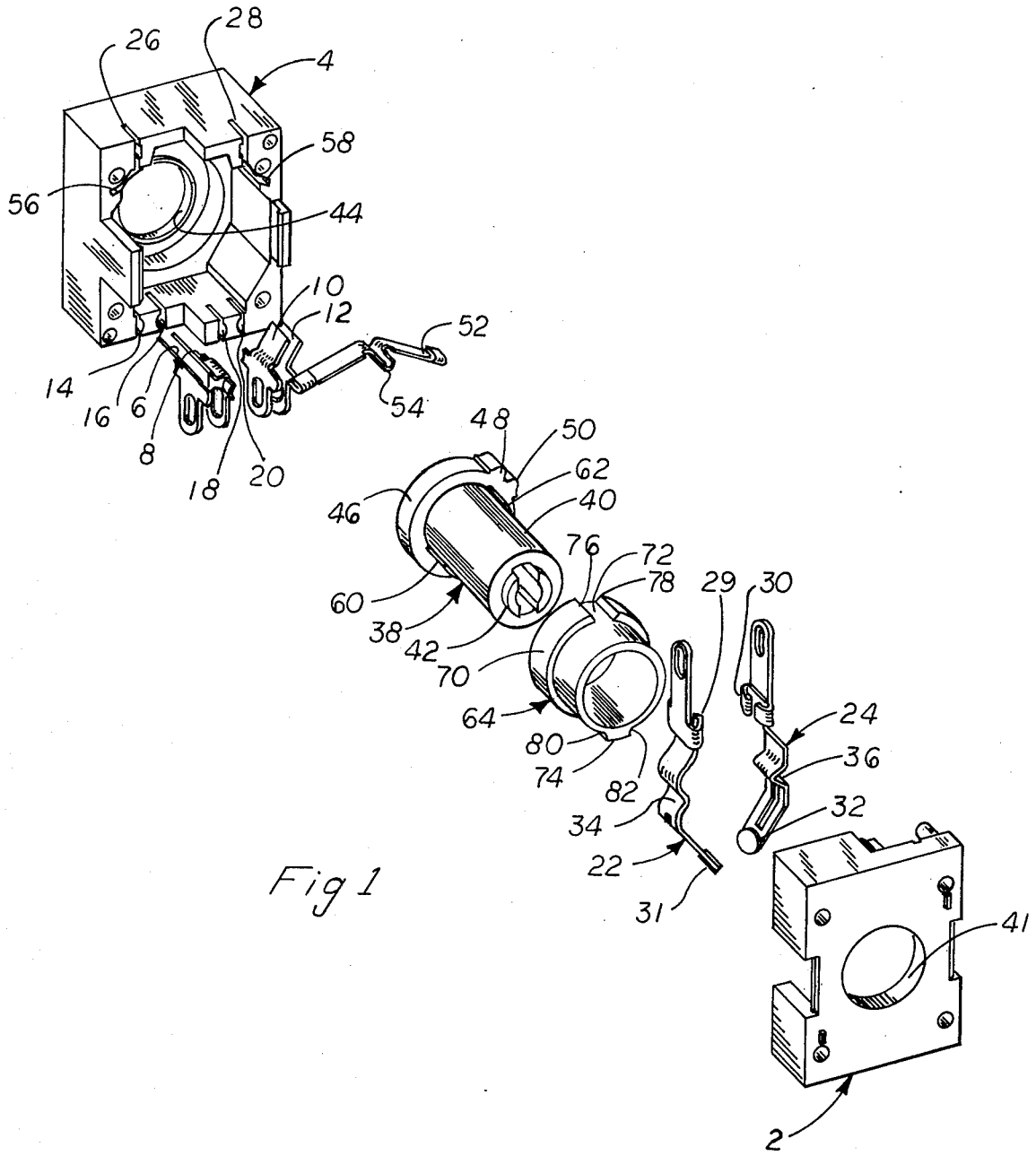
FIG. 1 is an exploded perspective view showing the components of the switch which is the subject of the present invention.
Figure 2:
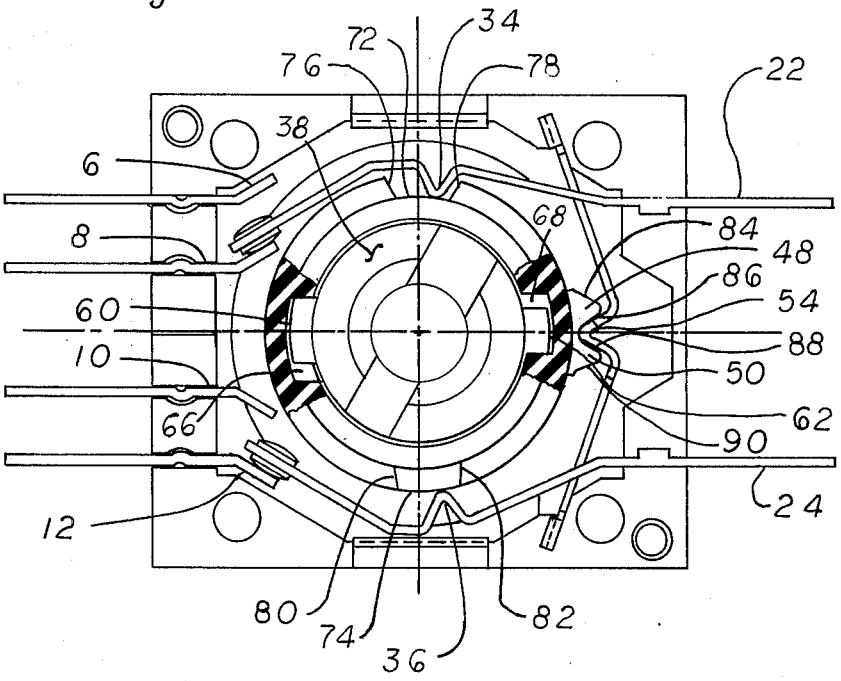
FIG. 2 is a plan view of the switch with the front cover removed.

Referring to FIGS. 1 and 2, a preferred embodiment of the snap-action switch contemplated by the present invention is shown. Plastic front and rear covers 2 and 4 mate to form an enclosed housing for the switch, although it should be understood that the switch housing could also be open without limiting the scope of the invention. Pairs of stationary electric contact terminal strips 6, 8 and 10, 12 are respectively lodged in slots 14, 16, 18, and 20 in the lower portion of rear cover 4 and extend out of the housing for connection to an external circuit. Each of the terminal strips is bowed where it snugly fits into its receiving slot, which is similarly bowed, to provide a tighter fit. A pair of flexible, resilient contact strips 22 and 24 are held at their upper ends in slots 26 and 28 of rear cover 4 by mounting structures 29 and 30, described in greater detail below, and extend down to the vicinity of the stationary terminal strips. Contacts 10, 12, and 24 are positioned somewhat forward of contacts 6, 8, and 22 so as to match up with the switch actuating mechanism described below. The lower end of contact strip 22 is positioned between stationary terminal strips 6 and 8 and is provided on each side with a pad 31 for making electrical connection with these terminal strips, while the lower end of contact strip 24 is positioned between stationary terminal strips 10 and 12 and similarly has a pad 32 on each side. The upper ends of contact strips 22 and 24 extend out of the housing to receive an external connection, while their intermediate portions are respectively provided with "V" shaped bends 34 and 36 which point generally inward toward the center of the switch. The apices of these bends are cammed by the switch actuating mechanism to move the inner portions of the contact strips back and forth so as to make an electrical connection with one or the other of their associated stationary terminal strips.

A generally cylindrical drive member 38 is held in the housing with a shaft 40 extending forward through an opening 41 in the front cover 2. A pair of receiving tangs 42 are provided at its forward end for mating with other switch or potentiometer modules, while an opening 44 in rear cover 4 provides access to the rear of the drive member. At the rear of shaft 40 is an annular flange 46 having a pair of outwardly projecting, adjacent caret-shaped protuberances 48 and 50. A double cantilever detent spring 52, shown in greater detail in FIGS. 4 and 5, has a central detent 54 which is normally seated between protuberances 48 and 50. Spring 52 is held in slots 56 and 58 in rear cover 4 and provides the thrust for achieving a snap-action switching motion. Drive member 38 further includes a pair of bosses 60 and 62 on its outer surface adjacent to flange 46. Concentrically fitted over drive member 38 is a generally cylindrical driven member 64 having an axial interior opening of a diameter slightly greater than the external diameter of shaft portion 40. A pair of recesses 66 and 68 (shown in FIGS. 2 and 3) are formed in the interior wall of driven member 64 in alignment with and of slightly greater circumferential dimension than bosses 60 and 62. The recesses together with the bosses form a lost motion coupling by which drive member 38 can be rotated in one direction and then in the opposite direction, moving driven member 64 through the same rotation except for a slippage of substantially the lost motion distance (the difference in circumferential dimension between the bosses 60 and 62 and the recesses 66 and 68) when its direction of rotation is reversed. Alternately, inward directed bosses could be placed on the inner surface of driven member 64 and received in recesses in the outer drive member 38 to form the lost motion coupling. Various coupling mechanisms mounted on the sides of the drive and driven members could also be envisioned.

Driven member 64 is further provided with a switch actuator which comprises a raised band 70 around its outer rear circumference, the band 70 having an interruption 72 therein within which the V bend 34 of contact strip 22 is normally seated. At the forward end of driven member 64 and diametrically opposite to band interruption 72 is an outwardly directed cam member 74 which normally provides a base against which the V bend 36 of contact strip 24 rests. Each of the contact strips 22 and 24 is flexed outward by driven member 64 to a position from which they snap inwards whenever member 64 is rotated and they come to an area of reduced diameter. Interruption 72 is bounded by cam surfaces 76 and 78 at the edges of band 70, while camming member 76 has a pair of lateral cam surfaces 80 and 82. Each of these cam surfaces provides a means for switching contact strips 22 and 24 from one switching state to another.

The switch is shown in its normal rest position in FIG. 2, with the spring detent 54 dwelling between protuberances 48 and 50. Referring in greater detail to the last named members, it will be seen that, when driven member 64 is rotated in a counterclockwise direction, the leading edge of protuberance 48 forms a ramp 84 which faces forward in the direction of rotation, while the trailing edge forms a rearward facing ramp 86. Similarly, the two sloped edges of protuberance 50 form forward and rearward facing ramps 88 and 90. In the position shown, V bend 34 of contact strip 22 is flexed inwardly against driven member 64, close to but spaced from cam surface 78, while V bend 36 of contact strip 24 is flexed outwardly on cam member 74.

Figure 3:
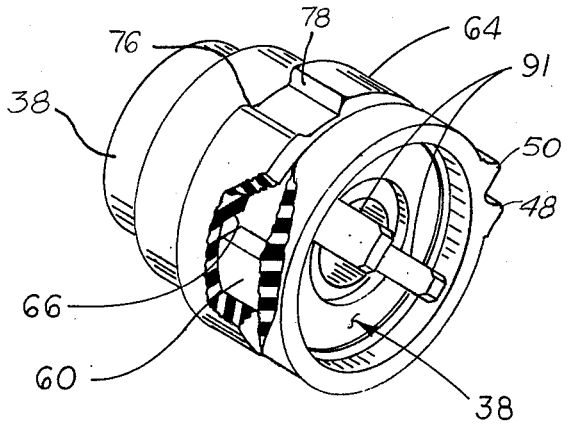
FIG. 3 is a perspective view showing the reverse side of the lost motion couping illustrated in FIG. 1.

Referring to FIG. 3, the lost motion mechanism is shown from a rearward perspective. In this view a pair of drive tangs 91 can be seen extending rearwardly from drive member 38. These tangs project through opening 44 in the housing to mate with receiving tangs in an adjacent module.

The features of detent spring 52 are shown in greater detail in FIGS. 4 and 5. The spring is stamped from sheet metal and comprises a pair of arms 92 and 94 and an intermediate generally V-shaped detent 54. Considerable stress is developed on the detent during operation of the switch, and the spring 52 is accordingly designed to distribute flexing and stressaway from the detent. This is accomplished by strengthening the detent, weakening other areas of the spring, and ensuring that the spring is tightly mounted to the housing to promote flexing at the mounted ends. Detent 54 includes an extension 96 which projects beyond the width of arms 92 and 94 and also has a pair of ribs 96 and 100 stamped in from its apex for additional strengthening. The spring arms are each cut away adjacent to the detent to leave areas of reduced width 102 and 104, which areas tend to take up more of the spring flexing than if they were full width. Tabs 106 and 108 are stamped at the ends of arms 92 and 94 respectively and folded back over the arms to form small cantilever springs which fit snugly into slots 56 and 58 on the rear housing section 4.

The mounting structure 29 for contact strip 22 is depicted in FIG. 6 in a position ready for insertion into housing slot 28. Mounting structure 30 for contact strip 24 is identical but reversed in orientation. The strip forms a base portion 110 from either lateral side of which extensions 112 and 114 are stamped and bent back towards the center axis of the strip to form cantilever spring arms. The end portion 116 and 118 of each arm 112 and 114 is bent further so as to project back toward base 110. End projections 116 and 118 are considerably shorter than their respective arms 112 and 114, and accordingly can flex only stiffly about their joinder with the arms as compared to the relatively easy flexing of arms 112 and 114 about their joinder with base 110. With the arms unflexed, projections 116 and 118 are spaced from base 110.

The contact strip is attached to the switch housing by inserting mounting structure 29 sideways into slot 26 in the housing before front cover 2 is put on, slot 26 extending from the interior to the exterior of the housing with one side exposed to the interface between front and rear housing covers 2 and 4. During insertion base 110 slides against one side of the opening to slot 26 and one of the spring arms 112 against the opposite side. The spring arm is gradually flexed inward, guiding the mounting structure into the slot, until projection 116 bottoms against base 110 (indicated in dashed lines in FIG. 6). The resistance of the spring arms to flexing is low enough that this initial insertion can be done by hand. Thereafter a much greater insertion forceis necessary to fully seat the mounting structure in slot 26, the thickness of which is slightly less than that of the mounting structure with projections 116 and 118 just bottomed against base 110. This greater force is required because bottoming of projections 116 and 118 against base 110 greatly increases the resistance to further inward flexing of spring arms 112 and 114. Fully inserting the mounting structure effectively locks the terminal strip in place without any cement being required. Movements of the portion of the terminal strip outside the housing are substantially isolated from the switching portion inside the housing, thereby preventing movements associated with external connectors from interfering with the switching mechanism. The elimination of cement prevents possible degradation that might otherwise occur when external connectors are soldered onto the contact strip.

In operation, shaft 40 is engaged to rotate drive member 38 counterclockwise, as seen in FIG. 2, bringing bosses 60 and 62 into abutment with the side walls of recesses 66 and 68. Further rotation of the drive member causes driven member 64 to also rotate, while the vertex of spring detent 54 slidingly rides up the inner ramp 88 of protuberance 50. The various components are dimensioned such that the spring detent 54 reaches the apex of protuberance 50 just before the V bend 34 of contact strip 22 is contacted by cam surface 78. Further rotation of the drive member brings the spring detent 54 over ramp 90, allowing the spring to release tension and ride down that ramp. This in turn accelerates drive member 38 in a counterclockwise snap-action motion. During this accelerated motion V bend 38 snaps up along cam surface 78 to rest on the top of band 70, switching the connection of contact strip 22 from stationary contact 8 to stationary contact 6. Shortly thereafter V bend 36 rides down cam surface 80 to the outer surface of driven member 64, switching the connection of contact strip 24 from stationary contact 12 to stationary contact 10 in a snap-action motion. Each of the contact strips 22 and 24 passes through its switching zone, i.e., the rotational distance during which it is moving along its respective cam surface from one switching state to another, during its respective period of acceleration. In this manner arcing is minimized and a positive switching action achieved. Although the two contact strips and their associated camming surfaces are shown slightly out of symmetry so as to operate in a staggered sequence, this is a convenience for external circuit purposes, and they could also be operated simultaneously. Also, it might be desirable to employ only one flexible switching contact.

In order to return to the initial switching state, drive member 38 is rotated in the opposite direction. Driven member 64 remains stationary until the drive member has taken up the lost motion distance, bosses 60 and 62 traversing recesses 66 and 68 to abut against the opposite recess walls. Thereafter the drive and driven members rotate together. As they approach their original positions spring detent 54 rides up outer ramp surface 90, increasing the spring tension. After the apex of protuberance 50 has passed by, the detent spring rides down inner ramp surface 88, accelerating the drive and driven members in a snap-action motion back to their original positions and at the same time causing contact strips 22 and 24 to switch back to their original state. It can thus be seen that effective bidirectional, snap-action switching is achieved. With simultaneously operating contacts, the drive shaft could be rotated in the opposite direction to produce a similar switching action between detent spring 52 and protuberance 48. In the present embodiment, however, it is necessary to rotate away from the rest position in only one direction, with protuberance 48 being used only as a stop.

Each of the protuberances 48 and 50 is shown as extending over an angular distance of approximately 20°. This dimension is arbitrary, and could be changed to alter the amount of operating torque or strength of the snap-action movement. The exact shape of the protuberances is also subject to variation. For example, their associated ramps could be either straight or curved, and one ramp could have a greater slope than the other.

Figure 7:
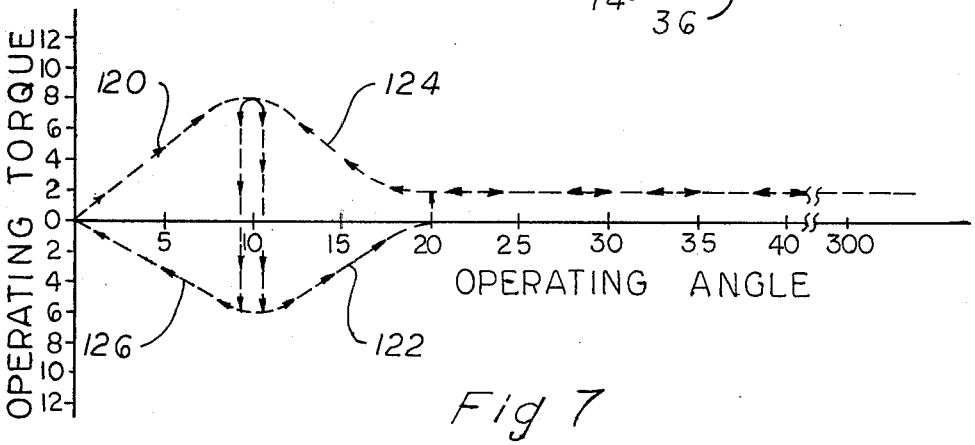
FIG. 7 is a graph illustrating the torque applied by an operator to the switch.

FIG. 7 shows the operating torque required to rotate the drive shaft 40, plotted against the angular position of drive member 38. A negative torque value indicates the drive member is undergoing a snap-action motion and is carrying the operator with it. Beginning from zero, a progressively increasing torque, indicated by curve segment 120, is required to rotate the drive member as the spring detent 54 rides up the inner protuberance ramp 88. At about 10° the spring begins to ride down outer ramp 90 and impart an accelerated snap-action motion to the drive member, and thereby to the driven member. It is during this snap-action motion, indicated by curve segment 122, that switching takes place. The lower end of ramp 90 is reached at approximately 20°, from which point torque must again be applied for continued rotation. Rotation beyond this point would be desirable should additional snap-action mechanisms be located around the periphery of drive member 38, and also when the switch is used as part of a modular design in conjunction with other switches and/or potentiometers.

Upon reversing the direction of rotation, the operating torque will be as indicated on the curve by arrows pointing to the left. Spring detent 54 rides back up ramp 90 as indicated by curve segment 124, passes the apex of the protuberance, and then accelerates the drive member in a snap-action motion back to its original position as it rides down ramp 88, this latter movement being indicated by curve segment 126. It should be noted that, while switching occurs in the forward direction of rotation while the drive member is along curve segment 122 and in the reverse direction while the drive member is along curve segment 126, the angular position of the driven member during switching is the same in both directions due to the lost motion coupling. It should also be observed that, while the protuberances 48 and 50 are shown in the drawings with a particular shape, both the slope and curvature of their ramps could be altered. The critical requirement is that complete and rapid switching occur when the driven member is accelerated.

Figure 8:
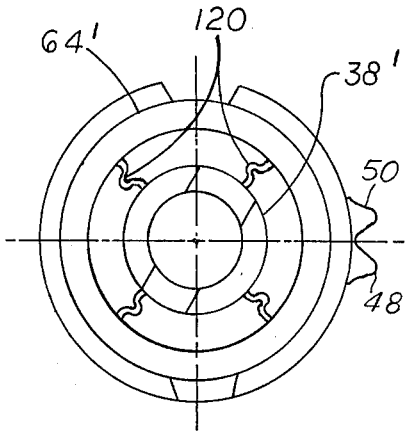
FIG. 8 is a plan view of another lost motion coupling embodiment.

FIG. 8 illustrates an alternate type of lost motion coupling in which a plurality of webs 120 are attached at either end to a drive member 38' and driven member 64', which members are radially separated in the coupling area. The length of the webs is greater than the radial spacing between the drive and driven members, leaving a slackness in the webs which is employed as a lost motion coupling when the drive member is rotated and takes up the slack.

While particular embodiments of the invention have been shown and described, numerous additional modifications and variations are possible in light of the above teachings. It is therefore intended that the scope of the invention be limited only in and by the terms of the appended claims.

What is claimed is:

1. A reversible snap-action switch, comprising:

a switch means, an operating drive member, a driven member having means to actuate said switch means, said driven member being movable through a switching zone in a given direction and in a direction reverse to said given direction to move said switch means respectively from a first to a second switching state and back to said first switching state, lost motion means coupling said drive member in bidirectional driving relation with said driven member, said drive member being operable to drive said driven member through said switching zone in a given direction and thereafter to reverse its direction and drive said driven member back through said switching zone in the reverse direction, the relative position of said drive and driven members being shifted by substantially the lost motion distance between the beginning of drive movements in opposite directions, and means for accelerating said drive member in said given and reverse directions in a snap-action motion, the action of said accelerating means being coordinated with the position of said driven member to effect switching in each direction during a snap-action motion.

2. The switch of claim 1, wherein said accelerating means comprises means for accelerating said drive member when said driven member is in the vicinity of the switching zone, said drive member being adapted to take up the lost motion distance upon reversal of its direction subsequent to a snap-action movement.

3. The switch of claim 1, wherein said drive and driven members are generally cylindrical and mutually concentric.

4. A reversible snap-action rotary switch comprising:

a housing, a set of switch contacts supported by said housing, a rotatable driven member held in said housing and accessible from the exterior thereof, a rotatable driven member disposed concentrically with respect to said drive member, means associated with said driven member for switching said contacts between first and second switching states as said driven member is rotated through a switching zone, lost motion means coupling said drive member in driving relation to said driven member, said drive member being adapted to take up the lost motion distance upon reversal of its direction of rotation, and bidirectional means responsive to said drive member reaching a predetermined rotational position for accelerating said drive member and thereby imparting a snap-action motion to said driven member as it traverses said switching zone.

5. The rotary switch of claim 4, wherein said contact switching means comprises cam means formed on an outer surface of said driven member and adapted to move at least one of said contacts when said driven member is accelerated.

6. The rotary switch of claim 5, said moved contact comprising a portion of a flexible, resilient conductive strip and biased thereby against said ramp means.

7. The rotary switch of claim 6, said housing having a slot associated with said conductive strip, said slot extending from the outside to the inside of said housing with a side exposed during assembly of said switch for insertion of said strip, said strip having said contact at one end inside said housing, the other end outside said housing, and a mounting means on an intermediate portion lodged in said slot to mount said strip and isolate mechanical movements at one end thereof from the other end, said mounting means comprising a base portion coplanar with said strip, a pair of cantilever spring arms extending toward the axis of said strip from opposite sides of said base portion, and stiffly flexible means projecting from each of said spring arms back toward said base, said spring arms each having an unflexed position in which said projecting means are spaced from said base, the resistance to inward flexing of said spring arms being substantially increased by said projecting members bottoming against said base, the thickness of said slot being slightly less than that of said mounting means with said projecting means just bottomed against said base, whereby one of said spring arms and base serve to guide insertion of said mounting means into said slot until said projecting means has bottomed against said base, and further insertion deforms said projecting means to lock said mounting means in said slot.

8. The rotary switch of claim 7, wherein each of said projecting means comprises extensions of their respective spring arms bent back toward said base.

9. The rotary switch of claim 8, said base, spring arms, and projecting means all being formed integrally with said conductive strip.

10. The rotary switch of claim 5, and further including a second set of switch contacts held by said housing and second cam means, said second cam means being formed on an outer surface of said driven member and adapted to move at least one of said second set of contacts in synchronism with the first set of contacts as said driven member is accelerated, one of said cam means producing a cam fall motion and the other a cam rise motion with its associated contact.

11. The rotary switch of claim 4, wherein said accelerating means comprises the combination of a first generally caret-shaped protuberance having forward and rearward facing ramps relative to the direction of rotation projecting from said drive member, and spring means supported by said housing for engagement with said protuberance, said spring means being disposed to flexingly ride up one of said ramps as said drive member is rotatingly advanced and to accelerate said drive member in the direction of rotation by riding down the other of said ramps and releasing spring tension, thereby imparting a snap-action motion to said driven member.

12. The rotary switch of claim 11, and further including a second caret-shaped protuberance having forward and rearward facing ramps relative to the direction of rotation projecting from said drive member adjacent to said first protuberance, said first and second protuberances forming therebetween a rest for said spring means, and means associated with said driven member for switching said contacts between first and second switching states as said driven member is rotated through a switching zone associated with said second protuberance.

13. The rotary switch of claim 11, wherein said drive and driven members comprise mutually concentric, generally cylindrical members.

14. The rotary switch of claim 13, wherein said protuberance projects generally radially outward from the periphery of said drive member.

15. The rotary switch of claim 13, wherein said drive member is disposed concentrically inward of said driven member.

16. The rotary switch of claim 15, wherein a portion of said drive member extends axially beyond said driven member, said drive member including a flange on its extended portion with said protuberance being located on said flange.

17. The rotary switch of claim 16, wherein said lost motion coupling comprises a recess formed in one of said drive and driven members and a boss projecting from the other of said members and extending into said recess, the size of said boss in the direction of rotation being less than that of said recess by substantially the lost motion distance.

18. The rotary switch of claim 17, wherein said recess is formed in an inner surface of said driven member and said boss projects from an outer surface of said drive member.

19. The rotary switch of claim 13, wherein said lost motion coupling comprises a plurality of webs joining said drive and driven members, said webs being greater in length than the radial distance between said drive and driven members to enable a lost motion rotational movement between said members.

20. The rotary switch of claim 11, said spring means comprising a double cantilever spring having two arms and an intermediate detent, each of said arms being supported at the opposite end from said detent by said housing, said detent being generally V-shaped with its vertex disposed to slidingly contact the ramps of said protuberance.

21. The rotary switch of claim 20, and further including means to strengthen the flexing resistance of said detent relative to said arms, thereby distributing the spring flexing and stress away from said detent.

22. The rotary switch of claim 21, wherein the detent is extended beyond the width of said arms in a plane generally normal to the flexing plane.

23. The rotary switch of claim 22, and further including at least one strengthening rib formed along the inside of said detent vertex.

24. The rotary switch of claim 22, each of said arms including areas of reduced width proximate to said detent to enhance spring flexing in the reduced width areas.

25. The rotary switch of claim 22, said housing including receiving slots for said arms, said slots being of a greater thickness than the thickness of said arms, the ends of said arms opposite from said detent being folded over to snugly fit in said slots.

26. Means for concurrently mounting an electrically conductive strip having a contact at one end and a terminal at the other end to an intermediate wall having a slot for receiving said strip and isolating mechanical movements at one end of said strip from the other end, said means comprising a base portion coplanar with said strip, a pair of cantilever spring arms extending toward the axis of said strip from opposite sides of said base portion, and stiffly flexible means projecting from each of said spring arms back toward said base, said spring arms each having an unflexed position in which said projecting means are spaced from said base, the resistance to inward flexing of said spring arms being substantially increased by said projecting members bottoming against said base, the thickness of said slot being slightly less than that of said mounting means with said projecting means just bottomed against said base, whereby one of said spring arms and base serve to guide insertion of said mounting means into said slot until said projecting means has bottomed against said base, and further insertion deforms said projecting means to lock said mounting means in said slot.

27. The invention of claim 26, wherein each of said projecting means comprises extensions of their respective spring arms bent back toward said base.

28. The invention of claim 27, said base, spring arms, and projecting means all being formed integrally with said conductive strip.

* * * * *

UNITED STATES PATENT OFFICE

CERTIFICATE OF CORRECTION

PATENT NO. : 4,025,738

DATED : May 24, 1977

INVENTOR(S) : Carl Lloyd Erwin, Michael John Howett, Howard Hideo Nojiri

It is certified that error appears in the above-identified patent and that said Letters Patent are hereby corrected as shown below:

Column 1, Line 57, "conact" should be -- contact --.

Column 1, Line 59, "swtich" should be -- switch --.

Column 2, Line 61, "ensuring" should be -- ensuing --.

Column 3, Line 2, "couping" should be -- coupling --.

Column 4, Line 15, "outer drive" should be -- outer surface of drive --.

Column 4, Line 33, "76" should be -- 74 --.

Column 4, Line 63, "stressaway" should be -- stress away --.

Column 5, Line 40, "forceis" should be -- force is --.

Column 6, Line 5, "38" should be -- 34 --.

Column 8, Line 15, "driven" should be -- drive --.

Signed and Sealed this

*thirtieth* Day of *August 1977*

[SEAL]

*Attest:*

RUTH C. MASON
*Attesting Officer*

C. MARSHALL DANN
*Commissioner of Patents and Trademarl*